US005239780A

United States Patent [19]

Mott et al.

[11] Patent Number: 5,239,780

[45] Date of Patent: Aug. 31, 1993

[54] MILTI-FUNCTION WRAP

[75] Inventors: Richard A. Mott, Alexandria; Kenneth I. Wells, Granville, both of Ohio

[73] Assignee: Owens-Corning Fiberglas Technology, Inc., Summit, Ill.

[21] Appl. No.: 997,379

[22] Filed: Dec. 28, 1992

[51] Int. Cl.[5] ..... E06B 1/00

[52] U.S. Cl. ..... 49/380; 49/460; 206/325

[58] Field of Search ..... 49/380, 460, 506, 504; 206/325; 52/741.1, 741.4

[56] References Cited

U.S. PATENT DOCUMENTS

| | | | |
|---|---|---|---|
| 2,746,667 | 5/1956 | Murphy | 229/14 |
| 2,887,219 | 5/1959 | Lester, Jr. | 206/325 |
| 2,917,789 | 12/1959 | LeBon, III | 49/504 X |
| 3,023,464 | 3/1962 | Zerbe | 49/380 X |
| 3,939,978 | 2/1976 | Thomaswick | 206/454 |
| 4,204,373 | 5/1980 | Davidson | 52/204 |
| 4,344,265 | 8/1982 | Davidson | 52/741 |
| 4,483,101 | 11/1984 | Berzina | 49/380 |
| 4,691,477 | 9/1987 | Governale | 49/380 |
| 4,742,647 | 5/1988 | Pacca | 49/505 |
| 4,999,957 | 3/1991 | Kessler | 52/213 |
| 5,027,569 | 7/1991 | Keys | 52/208 |

*Primary Examiner*—Philip C. Kannan
*Attorney, Agent, or Firm*—Ted C. Gillespie

[57] ABSTRACT

A wrap useful as a structural element to prevent racking and jamb bowing of a window assembly and door assembly during transport and installation and, after installation, as an integral vapor barrier and air infiltration seal. The window and door assemblies each including a frame having an outward edge defining an outer face therebetween and an inward edge defining an inner face therebetween. The wrap including a film of material having an outer marginal edge secured between the frame outward edge and frame inward edge and stretched taut across a face of the frame to maintain the frame in an unracked position.

20 Claims, 4 Drawing Sheets

MILTI-FUNCTION WRAP

TECHNICAL FIELD

This invention relates to a multi-function wrap. More particularly, this invention relates to a multi-function wrap useful as a structural element to prevent racking and jamb bowing of a premanufactured window assembly or prehung door assembly during transport and installation and, after installation, as an integral vapor barrier and air infiltration seal.

BACKGROUND ART

This invention is concerned with a multi-function wrap useful as a structural element to prevent racking and jamb bowing of a window assembly and a door assembly during transport and installation and, after installation, as an integral vapor barrier and air infiltration seal. A common problem associated with premanufactured window assemblies and door assemblies is that during transport and installation the assemblies are susceptible to stresses which distort the frame of the assemblies such that the corners of the frame are not right angles. The term for this distortion is called "racking". This distortion of the frames may result in misalignment and binding of the window sashes or door in the frame during and after installation resulting in unsatisfactory operation of the window or door.

Acceptable limits on the magnitude of racking of a window frame as determined by the relative horizontal displacement of a head of the window frame with respect to a sill of the window frame on a typical vertical sash window 6 feet or more in height and 3 feet or less in height is 0.1 of an inch or less and 0.05 of an inch or less, respectively. Similarly, acceptable limits on the magnitude of racking of a door frame as determined by the relative horizontal displacement of a head of the door frame with respect to a sill of the door frame on a typical single prehung door frame 6 feet or more in height is 0.1 of an inch or less.

In the past, premanufactured window frames and door frames have been rigidified to prevent racking by the application of tight banding around the frame of the window assembly or door assembly or across the frame vertically and/or horizontally. The rigidifying systems were then removed from the window assembly or door assembly prior to or after installation of the window or door. After installation of the window or door the rigidifying systems serve no useful purpose and impede the operation of the window or door and therefore must be removed from the window assembly or door assembly and discarded. It will be appreciated that disposal of the rigidifying system by burning or dumping in a landfill further exemplifies the waste and inefficiency of the banding process. A representative rigidifying system employing banding is disclosed in U.S. Pat. No. 4,691,477.

Additional rigidifying systems for window assemblies have been known to employ shipping clips to retain pivot pins engaged and maintain the sash closed and in a non-racked position. However, the use of shipping clips and pivot pins suffer from the disadvantage that the pins are susceptible to being pulled out of the window when the window is turned on the side.

It will be appreciated from the foregoing that there is still a significant need for an improved rigidifying system to prevent racking of a window or prehung door during transport and installation that overcomes the problems of the prior art.

Accordingly, one aspect of the present invention is to provide a rigidifying system entailing a wrap useful as a structural element to prevent racking and jamb bowing of a premanufactured window or prehung door during transport and installation and, after installation, useful as an integral vapor barrier and air infiltration seal. Another aspect of the present invention is to provide a wrap that maintains a prehung door or window in a nonracked position during transport and installation and protects the finish or the window surfaces from incidental bumps and nicks. Another aspect of the present invention is to provide a wrap that may be easily converted to a vapor barrier and air infiltration seal upon installation of the window or door. Still another aspect of the present invention is to provide a wrap that is simple and economical to manufacture. A further aspect of the present invention is to provide a door frame assembly or window frame assembly that is protected from bumps and nicks that may occur in the transport and installation of prehung door assemblies or premanufactured window assemblies.

DISCLOSURE OF THE INVENTION

Briefly, in accordance with one aspect of the present invention, there is provided a window assembly including a window frame and a window wrap. The window frame has two parallel spaced side jambs, a head joining a top edge of each side jamb and a sill joining a bottom edge of each side jamb. The window frame has an outward edge defining an outer face therebetween and an inward edge defining an inner face therebetween. The wrap includes a film of material having an outer marginal edge secured from between the window frame outward edge and window frame inward edge and stretched taut across a face of the window frame to maintain the window frame in an unracked position.

In a preferred embodiment, the window wrap is a thin impervious film material secured about the outer periphery of the window frame and draped over the inner side edges of the window frame across the interior of the window assembly thereby enveloping the inner face of the window assembly. The film may be a plastic material such as polyethylene or biaxially oriented polypropylene.

The film material may be secured about the periphery of the window frame by most any suitable means such as staples, glue and the like. In a preferred embodiment, the outer marginal edges of the film are wedged within a groove or kerf formed about the outer periphery of the window frame by a nailing fin of a type well known in the art.

The window wrap is applied to the window frame by first squaring the side jambs, head and sill of the window frame. A film of material having an outer marginal edge is then secured from between the window frame outward edge and window frame inward edge and stretched taut across a face of the window frame to maintain the window frame in an unracked position. In a preferred embodiment, a nailing fin is provided within a groove formed about the periphery of the window frame such that the film of material is secured between the nailing fin and the window frame.

The window assembly in accordance with the present invention is installed by securing the window assembly within a rough opening of a building and then cutting the film of material to expose the window frame inner face. Preferably, the film of material is cut to produce four triangular flaps having a common vertices and then the triangular flaps are fastened outwardly from the window frame such that the film functions as a vapor barrier and air infiltration barrier between the window frame and the rough opening of the building.

In accordance with another aspect of the present invention, the wrap may be applied to a door assembly including a door member hingedly connected to a door frame having two spaced side jambs and a head joining a top edge of each side jamb. The door frame includes an outward edge defining an outer face therebetween and an inward edge defining an inner face therebetween. The film of material having an outer marginal edge is then secured between the door frame outward edge and door frame inward edge and stretched taut across a face of the door frame to maintain the door frame in an unracked position. In a preferred embodiment the door member is hingedly connected to the side jamb to pivot about the inward edge and the film of material is stretched taut across the inner face of the door frame. The film outer marginal edge may be secured by staples or glue or the like between the door frame outward edge and the door frame inward edge. The door assembly in accordance with the present invention may be installed in a manner similar to the window assembly as previously described.

BRIEF DESCRIPTION OF THE DRAWINGS

Further features and other aspects and advantages of this invention will become clear from the following detailed description made with reference to the drawings in which.

DETAILED DESCRIPTION OF THE INVENTION INCLUDING THE BEST MODE OF CARRYING IT OUT

Figure 1:
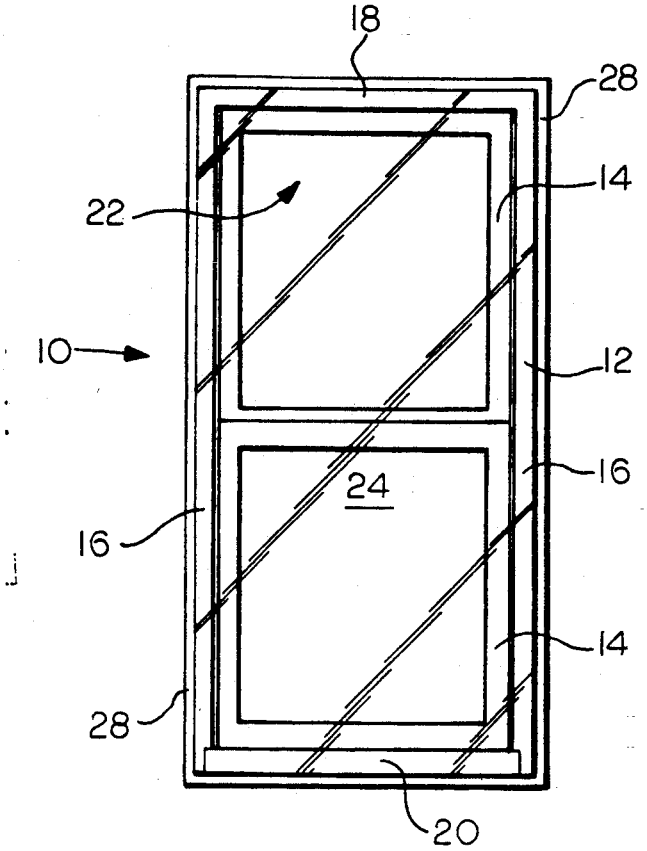
FIG. 1 is a front view of a window in accordance with the present invention.
Figure 2:
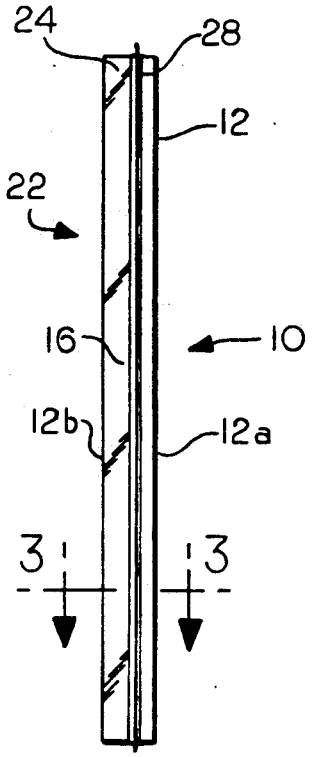
FIG. 2 is a side view of the window shown in FIG. 1.
Figure 3:
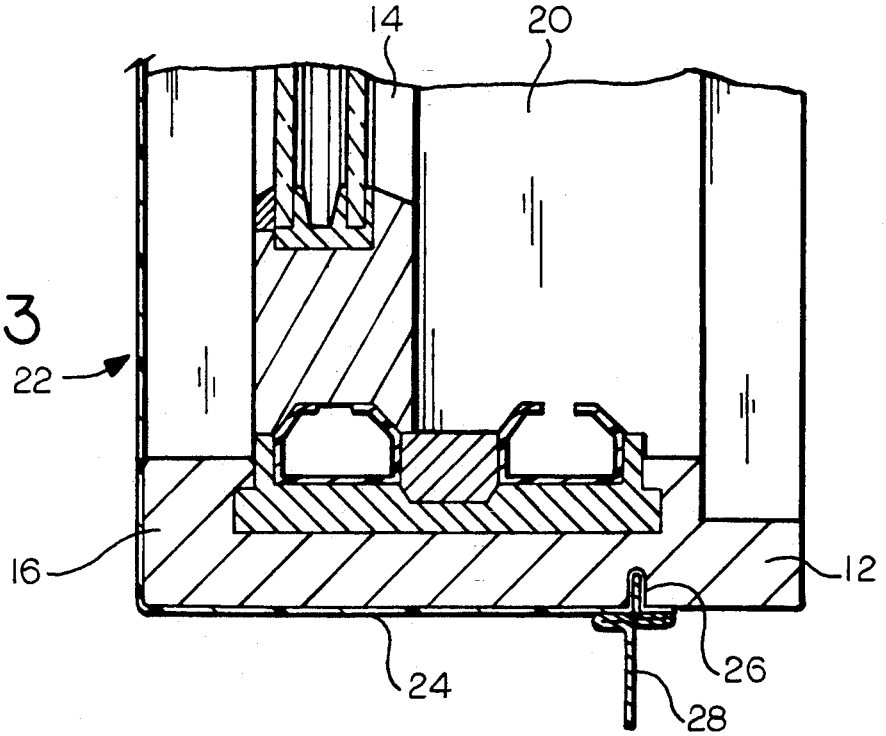
FIG. 3 is a cross sectional view of the window of FIG. 2 taken about line 3—3.

In the following description, like reference characters designate like or corresponding parts. Also, in the following description it is to be understood that such terms as front, rear, left, right, upper and lower and the like are words of convenience. Referring to the drawings wherein like reference characters represent like elements, FIGS. 1–6 illustrate a vertical sliding sash window assembly 10 and a door assembly 30 in accordance with the present invention. The vertical sliding sash window assembly 10 may be either a prime window assembly or a replacement window assembly. A window assembly installed in a structure as the structure is built is called a prime window assembly. A window assembly that is substituted in place of the prime window assembly is called a replacement window assembly.

The commonly known vertical sliding sash window assembly 10 consists mainly of a rectangular frame 12 and at least one sash 14. The vertical rectangular frame 12 holds the sashes 14 within the wall of the structure and is comprised of two side jambs 16, a head 18 and a sill 20. The common side jambs 16 are the parallel spaced vertical frame members and the head 18 is the top horizontal frame member joining the top of each side jamb. The head 18 and side jambs 16 are typically of equal width. The sill 20 part of the bottom of the window frame 12 slopes downward to prevent water from draining into the interior of the building.

The door assembly 30 of the present invention includes a door member 38 hingedly connected to a door frame 40 by hinges 36. The door frame 40 includes two spaced side jambs 32 and a head 34 joining a top edge of each side jamb. The door frame contains an outward edge 42 defining an outer face therebetween and an inward edge 44 defining an inner face therebetween. The door member 38 pivots about hinges 36 within the door frame 40 and seals against door stop (not shown) as known in the art.

As described above, the premanufactured window assembly 10 and door assembly 30 per se are conventional in construction and need not further be described to enable a full understanding of the present invention.

Wrapped tautly over the inner face 22 of the window frame 12 is a film 24. The film 24 is of sufficient thickness and size to maintain the window frame 12 in an unracked position. In a preferred embodiment, the film 24 is an impervious continuous sheet stretched taut across a portion of the outwardly facing surfaces of the side jambs 16, sill 20 and head 18 and window panes thereby preventing the window frame 12 from racking. The outer edges of the film 24 may be secured about the periphery of the window frame 12 from between the window frame outward edge **12*a* and window frame inward edge 12*b* and stretched taut across a face of the window frame by most any suitable means such as staples, glue and the like. In a preferred embodiment, the outer edges of the film 24 are secured by wedging the outer edges of the film within a groove or kerf 26 about the outer periphery of the window frame 12 by nailing fins 28 of a type well known in the art. The groove 26 is typically formed within the window frame 12 about the outer periphery thereof to secure the nailing fins 28. It will be appreciated that by securing the film 24 within the groove 26, the nailing fins 28 may operate unobstructed by the window wrap thereby facilitating ease of installation of the window assembly 10** within an opening.

As shown in FIG. 1, the film 24 is secured about the outer periphery of the window frame 12 and draped over the inner side edges of the window frame across the inner face 22 of the window assembly 10 thereby enveloping the interior face of the window assembly. It will be appreciated that by enveloping the interior face of the window assembly 10 the interior trim is protected from dents and scrapes and the interior surface of the window panes are maintained clean and dry during the installation process and, after installation, functions as a vapor barrier and air infiltration barrier. Although it is preferred that the film 24 be applied to the inner face 22 of the window assembly 10 the film may also be applied across the exterior face of the window assembly to prevent racking of the window frame 12.

The film 24 may be most any suitable commercially available material such as plastic and the like. Suitable plastic materials include polyethylene and biaxially oriented polypropylene.

Figure 4:
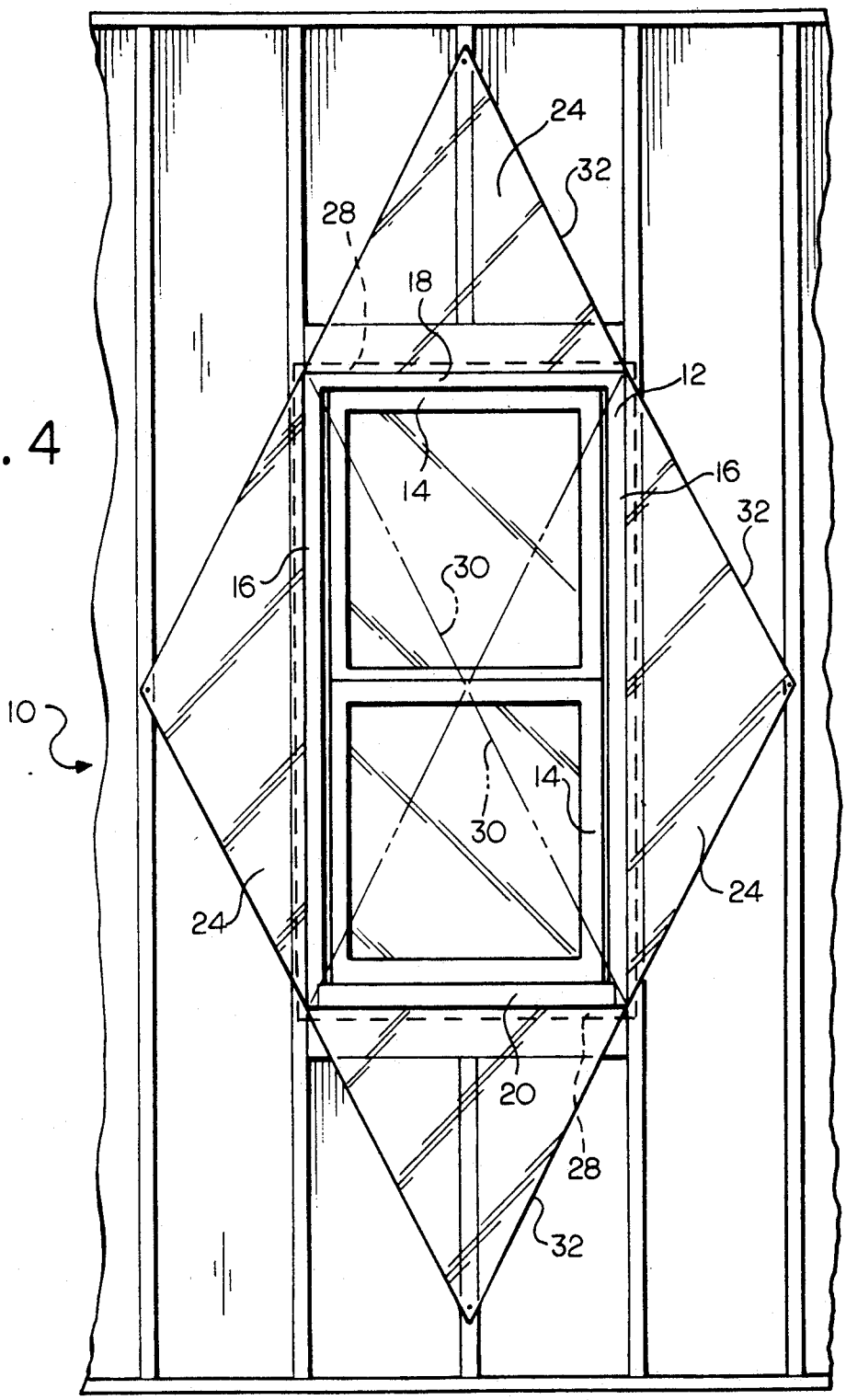
FIG. 4 is a front view of the window shown in FIG. 1 installed within an opening in a building.
Figure 5:
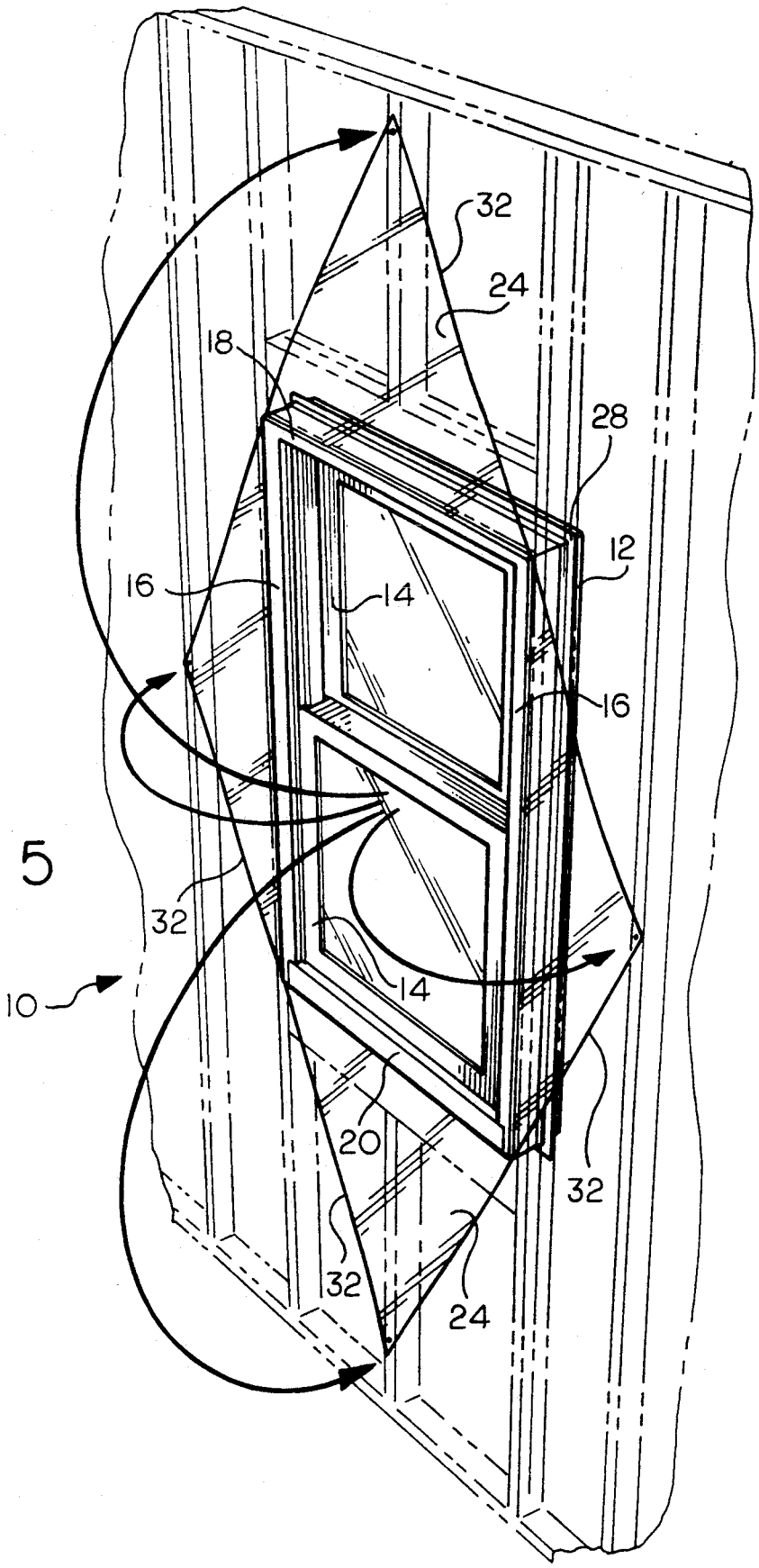
FIG. 5 is an isometric view of the window of FIG. 4.

As shown in FIGS. 4 and 5, the window assembly is installed in an opening within a building employing conventional construction techniques. Initially, a perimeter band retaining the nailing fins 28 flush with the window frame 12 is removed thereby releasing the nailing fins. The window assembly 10 is then positioned within a rough opening within a building and shimmed plum. The nailing fins 28 are then secured against the exterior of the building thereby fixing the window assembly 10 in position. Next, two crossing diagonal cuts 30 are made within the film 24 from corner to corner of the window frame 12 to produce four triangular flaps 32, each of which has a vertex which originally was at a common point. The triangular flaps 32 are then folded outwardly across the interior of the building and secured to the building structure thereby acting as a vapor barrier and air infiltration seal between the window frame 12 and the opening within the building. A final wall finish may then be applied over the triangular flaps 32 of the film 24 as desired.

In locales where vapor barrier and air infiltration properties are of diminished importance, the window assembly 10 may be installed in a conventional manner with the film 24 maintained intact. After application of a final wall finish to the building structure the film may then be removed from the inner face 22 of the window assembly. It will be appreciated that preserving the continuity of the film 24 across the inner face 22 of the window assembly 10 protects the window assembly from paint and the like thereby expediting completion of the final wall finish. Although, the invention is described in connection with a sliding sash window, it will be readily apparent that the present invention may be used with equal facility on a variety of window types, styles and sizes. Accordingly, the description of the present invention in connection with a sliding sash window is not to be construed as a limitation on the scope of the invention.

Figure 6:
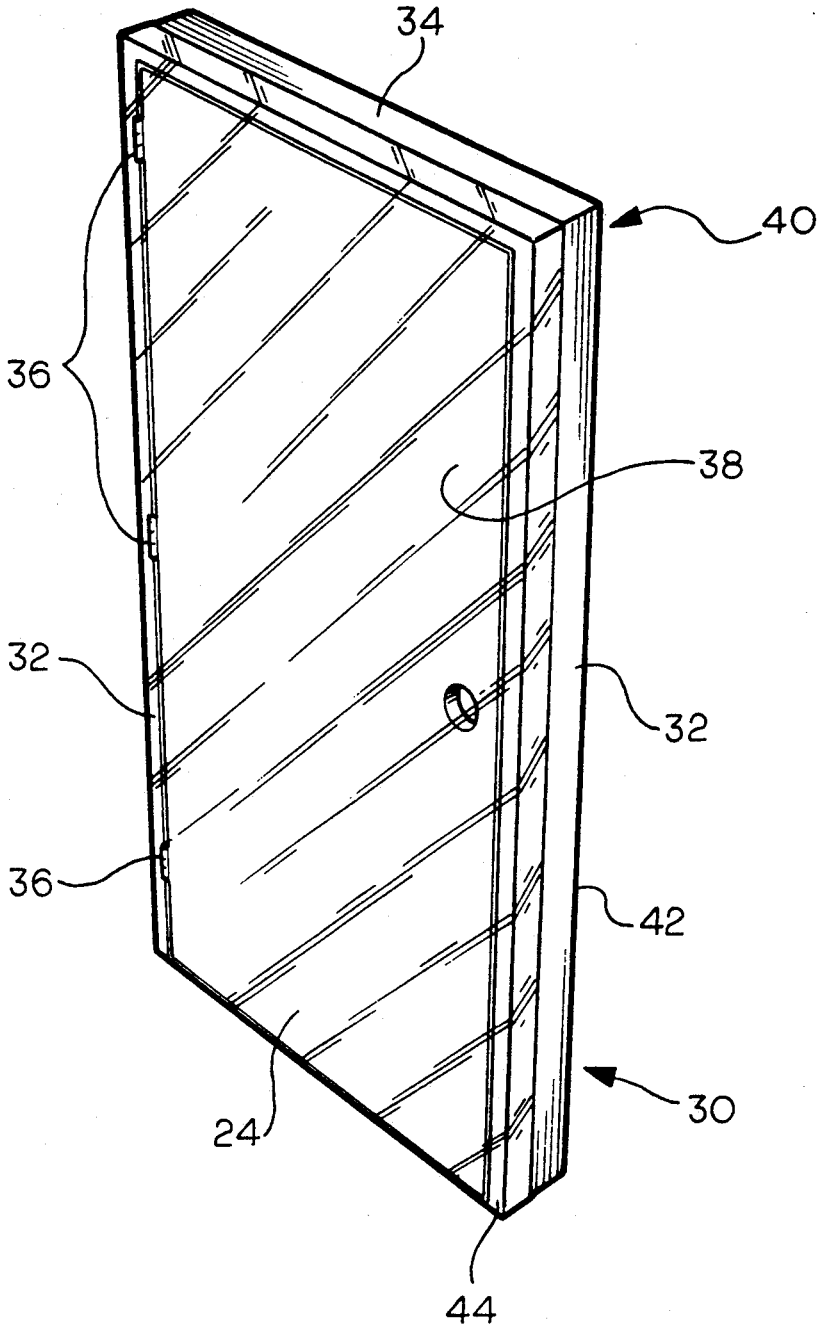
FIG. 6 is an isometric view of a prehung door in accordance with another aspect of the present invention.

In accordance with another aspect of the present invention, referring to FIG. 6, a film of material may be stretched tautly over a face of a door assembly 30 including a door member 38 and a door frame 40. The film of material 24 includes an outer marginal edge secured from between the door frame outward edge 42 and door frame inward edge 44 across a face of the door frame 40 to maintain the door frame in an unracked position. As shown the door member 38 is hingedly connected to a side jamb 32 by hinges 36 to pivot about an inward edge 44 and the film of material 24 is stretched taut across the inner face of the door frame thereby maintaining the door member in an unracked position and secured against door stop (not shown). The outer marginal edges of the film of material 24 may be secured by staples or glue and the like between the door frame outward edge and the door frame inward edge. The door assembly 30 may then be installed in a manner similar to the window assembly as previously described.

Having described presently preferred embodiments of the invention, it is to be understood that it may be otherwise embodied within the scope of the appended claims.

We claim:

1. A window assembly comprising:

a window frame and at least one sash, said window frame having two spaced side jambs, a head joining a top edge of each side jamb and a sill joining a bottom edge of each side jamb, said window frame having an outward edge defining an outer face and an inward edge defining an inner face; and a wrap including a film of material having an outer marginal edge secured from between said window frame outward edge and window frame inward edge and stretched taut across a face of the window frame to maintain said window frame in an unracked position.

2. The window assembly of claim 1 wherein said film of material is stretched taut across an inner face of said window frame.

3. The window assembly of claim 2 wherein said window frame further comprises a groove formed about the outer periphery thereof.

4. The window assembly of claim 3 further comprising a nailing fin positioned within said groove.

5. The window assembly of claim 4 wherein said film outer marginal edge is secured within said groove between said nailing fin and said window frame.

6. The window assembly of claim 5 wherein said film is a plastic material.

7. The window assembly of claim 6 wherein said plastic ma is an impervious sheet of continuous plastic material.

8. The window assembly of claim 6 wherein said plastic material is selected from the group consisting of polyethylene and biaxially oriented polypropylene.

9. The window assembly of claim 8 wherein said plastic material is a continuous sheet of plastic material.

10. The window assembly of claim 1 wherein said film outer marginal edge is secured by staples between said window frame outward edge and said window frame inward edge.

11. The window assembly of claim 1 wherein said film outer marginal edge is glued between said window frame outward edge and said window frame inward edge.

12. The window assembly of claim 1 wherein said film is a continuous sheet of plastic material.

13. The window assembly of claim 12 wherein said film is an impervious sheet of plastic material.

14. A window assembly comprising:

a window frame and at least one sash, said window frame having formed about the outer periphery thereof a groove;

a nailing fin positioned within said groove; and a wrap including a continuous film of material stretched taut about the periphery of said window frame from said groove across an inner face of the window frame to maintain said window frame in an unracked position wherein said film outer edges are secured Within said groove between said nailing fin and said window frame.

15. A door assembly comprising:

a door member hingedly connected to a door frame having two spaced side jambs and a head joining a top edge of each side jamb, said door frame having an outward edge defining an outer face and an inward edge defining an inner face; and a wrap including a film of material having an outer marginal edge secured between said door frame outward edge and door frame inward edge and stretched taut across a face of the door frame to maintain said door frame in an unracked position.

16. The door assembly of claim 15 wherein said door member is hingedly connected to said side jamb to pivot about said inward edge and said film of material is stretched taut across the inner face of said door frame.

17. The door assembly of claim 16 wherein said film outer marginal edge is secured by staples between said door frame outward edge and said door frame inward edge.

18. The door assembly of claim 16 wherein said film outer marginal edge is glued between said door frame outward edge and said door frame inward edge.

19. The door assembly of claim 16 wherein said film is a plastic material.

20. The door assembly of claim 19 wherein said plastic material is selected from the group consisting of polyethylene and biaxially oriented polypropylene.

* * * * *